US006220782B1

(12) United States Patent
Yates

(10) Patent No.: US 6,220,782 B1
(45) Date of Patent: Apr. 24, 2001

(54) METHOD AND APPARATUS FOR ALTERING AN AGGREGATE GRADATION MIXTURE OF AN ASPHALT CONCRETE MIXTURE

(76) Inventor: Larry A. Yates, P.O. Box 11008, Columbia, SC (US) 29211

( * ) Notice: Subject to any disclaimer, the term of this patent is extended or adjusted under 35 U.S.C. 154(b) by 0 days.

(21) Appl. No.: 09/426,695

(22) Filed: Oct. 25, 1999

Related U.S. Application Data

(60) Provisional application No. 60/105,678, filed on Oct. 26, 1998.

(51) Int. Cl.[7] ..... E01C 7/06; E01C 23/12; E01C 23/14

(52) U.S. Cl. ..... 404/75; 404/77; 404/79; 404/90; 404/91; 404/95

(58) Field of Search ..... 404/90, 91, 75, 404/77, 79, 95

(56) References Cited

U.S. PATENT DOCUMENTS

| | | | | |
|---|---|---|---|---|
| 3,843,274 | * | 10/1974 | Gutman et al. | 404/91 |
| 4,124,325 | * | 11/1978 | Cutler | 404/75 |
| 4,186,968 | * | 2/1980 | Barton | 299/39 |
| 4,226,552 | * | 10/1980 | Moench | 404/92 |
| 4,317,642 | * | 3/1982 | Wirtgen | 404/72 |
| 4,347,016 | * | 8/1982 | Sindelar et al. | 404/95 |
| 4,453,856 | * | 6/1984 | Chiostri et al. | 404/91 |
| 4,458,763 | * | 7/1984 | Rao et al. | 404/90 |
| 4,473,320 | * | 9/1984 | Register | 404/91 |
| 4,534,674 | * | 8/1985 | Cutler | 404/75 |
| 4,545,700 | * | 10/1985 | Yates | 404/75 |
| 4,682,909 | * | 7/1987 | Mihara | 404/90 |
| 4,711,600 | * | 12/1987 | Yates | 404/95 |
| 4,784,518 | * | 11/1988 | Cutler | 404/79 |
| 4,793,730 | * | 12/1988 | Butch | 404/77 |
| 4,818,139 | * | 4/1989 | Brock et al. | 404/81 |
| 4,850,740 | * | 7/1989 | Wiley | 404/79 |
| 4,929,120 | * | 5/1990 | Wiley et al. | 404/77 |
| 4,946,307 | * | 8/1990 | Jakob | 404/91 |
| 4,971,476 | * | 11/1990 | Guillon | 404/91 |
| 4,974,993 | * | 12/1990 | Crabbi | 404/79 |
| 5,080,524 | * | 1/1992 | Lee | 404/90 |
| 5,291,876 | * | 3/1994 | Milstead | 126/343.5 A |
| 5,441,361 | * | 8/1995 | Campbell | 404/90 |
| 5,472,292 | * | 12/1995 | Wiley | 404/79 |
| 5,544,971 | * | 8/1996 | Huege et al. | 404/72 |
| 5,741,085 | * | 4/1998 | Wirtgen | 404/75 |
| 5,791,814 | * | 8/1998 | Wiley | 404/91 |
| 5,895,171 | * | 4/1999 | Wiley et al. | 404/77 |
| 5,921,706 | * | 7/1999 | Manatt et al. | 404/72 |

* cited by examiner

*Primary Examiner*—William Neuder
*Assistant Examiner*—Alexandra K. Pechhold
(74) *Attorney, Agent, or Firm*—Michael I. Kroll

(57) ABSTRACT

A method and apparatus for altering an aggregate gradation mixture of an asphalt concrete mixture. The apparatus includes a heater for heating a layer of existing roadway materials, a milling and mixing auger for milling the heated layer of existing roadway materials and a hopper and conveyor for providing a predetermined amount of treated new usable aggregates to the milling and auger for mixing with the heated layer of existing roadway materials in order to produce a new asphalt concrete mixture. The auger including a plurality of milling bits extending therearound for receiving the predetermined amount of aggregates and mixing them with the milled layer of existing roadway materials, the milling bits are slanted to direct the aggregates received thereby and milled layer to a center line of the apparatus. A second auger is positioned along the center line of the apparatus and behind the auger for further mixing the new asphalt concrete mixture. A shield plate is adjustably secured to the auger for separating and removing selected unusable aggregates from the material. The hopper is pre-loaded with the predetermined amount of treated new usable aggregates and the conveyor retrieves the aggregates from the hopper and provides the aggregates to the auger. The new mixture formed by the method and apparatus has the volumetric requirements for a superpave mix in accordance with the design system developed by the Strategic Highway Research Program of 1987.

21 Claims, 12 Drawing Sheets

PAVEMENT REMIXING MACHINE

PAVEMENT AGGREGATE GRADATION MODIFICATION CHART

| SIEVE SIZE | | % PASSING | | SUPERPAVE TYPE-1 | | | | LAYER | CHANGE | NEW | QUALITY | CELL |
|---|---|---|---|---|---|---|---|---|---|---|---|---|
| (IN) | (MM) | (MIN) | (MAX) | (-%) | (+%) | (AVG.) | (AVG.) | 1.5 | +/- | MIX | CONT'L | NO. |
| 1-1/2" | 37.5 | 100 | 100 | 0% | 0% | 0% | 0.00 | 0.00 | 0.00 | 0% | OK | 6 |
| 1" | 25 | 100 | 100 | 0% | 0% | 0% | 1.50 | 2.25 | 0.00 | 1% | OK | 7 |
| 3/4" | 19 | 100 | 100 | 0% | 10% | 5% | 8.50 | 12.75 | 0.00 | 6% | OK | 8 |
| 1/2" | 12.5 | 90 | 100 | 48% | 75% | 62% | 6.00 | 9.00 | 75.00 | 42% | OK | 9 |
| 3/8" | 9.5 | 0 | 0 | 0% | 0% | 0% | 18.00 | 27.00 | 0.00 | 14% | OK | 10 |
| #4 | 4.75 | 0 | 0 | 0% | 0% | 0% | 15.00 | 22.50 | 0.00 | 11% | OK | 11 |
| #8 | 2.36 | 25 | 42 | 0% | 26% | 21% | 21.00 | 31.50 | 0.00 | 16% | OK | 12 |
| #16 | 1.18 | 0 | 26 | 0% | 6% | 3% | 0.00 | 0.00 | 0.00 | 0% | OK | 13 |
| #30 | 0.6 | 0 | 20 | 0% | 6% | 2% | 16.00 | 24.00 | -13.33 | 5% | OK | 14 |
| #50 | 0.3 | 0 | 16 | 0% | 16% | 3% | 0.00 | 0.00 | 0.00 | 0% | OK | 15 |
| #100 | 0.15 | 0 | 0 | 0% | 0% | 0% | 8.50 | 12.75 | -7.08 | 3% | OK | 16 |
| #200 | 0.075 | 2 | 8 | 0% | 8% | 5% | 5.50 | 8.25 | -4.58 | 2% | OK | 17 |
| TOTAL PERCENT OR LBS OF MIXES: | | | | | | 100% | 100.00 | 150.00 | 50.00 | 100% | PASSED | 19 |
| A | B | C | D | E | F | G | H | I | J | K | L | M |

FIG 5A

PAVEMENT AGGREGATE GRADATION MODIFICATION CHART

| EXISTING TYPE-1B | EXISTING TYPE-1A | EXISTING TYPE-1 | EXISTING TYPE-3 | EXISTING TYPE-4 | | 1B | PERCENT PASSING 1B | 1A | 1A | 1L | 1H | 3L | 3H | 4L | 4H |
|---|---|---|---|---|---|---|---|---|---|---|---|---|---|---|---|
| | | | | | 1-1/2" | | | | | | | | | | |
| 5 | 2 | 0 | 0 | 0 | 1" | 100 | 100 | 100 | 100 | 100 | 100 | 100 | 100 | 100 | 100 |
| 14 | 9 | 2 | 2 | 2 | 3/4" | 90 | 100 | 97 | 100 | 100 | 100 | 100 | 100 | 100 | 100 |
| 30 | 6 | 9 | 9 | 4 | 1/2" | 72 | 90 | 82 | 98 | 97 | 100 | 97 | 100 | 97 | 100 |
| 0 | 18 | 24 | 22 | 13 | 3/8" | | | 74 | 94 | 80 | 100 | 80 | 100 | 90 | 100 |
| 12 | 15 | 16 | 15 | 13 | #4 | 42 | 60 | 54 | 78 | 58 | 75 | 58 | 78 | 70 | 95 |
| 19 | 21 | 22 | 24 | 35 | #8 | 30 | 48 | 42 | 60 | 42 | 60 | 42 | 64 | 58 | 82 |
| 0 | 0 | 0 | 0 | 0 | #16 | | | | | | | | | | |
| 10 | 16 | 17 | 17 | 22 | #30 | 12 | 29 | 22 | 38 | 19 | 40 | 18 | 40 | 20 | 50 |
| 0 | 0 | 0 | 0 | 0 | #50 | | | | | | | | | | |
| 6 | 9 | 8 | 8 | 7 | #100 | 6 | 16 | 8 | 20 | 6 | 20 | 5 | 20 | 6 | 20 |
| 5 | 6 | 6 | 5 | 6 | #200 | 2 | 8 | 3 | 8 | 3 | 8 | 2 | 8 | 2 | 10 |
| 100 | 100 | 100 | 100 | 100 | | | | | | | | | | | |
| N | O | P | Q | R | S | T | U | V | W | X | Y | Z | AA | AB | AC |

FIG 5B

| | | | | | | |
|---|---|---|---|---|---|---|
| SIEVE SIZE | | % PASSING | | SUPERPAVE | | |
| (IN.) | (MM) | (MIN) | (MAX) | (-%) | (+%) | (AVG.) |
| 1-1/2" | 37.5 | 100 | 100 | 0 | 0 | =(+E6+F6)/2 |
| 1" | 25 | 100 | 100 | 0 | 0 | =+(((C7+D7)/2)-((C8+D8)/2))/100 |
| 3/4" | 19 | 100 | 100 | 0 | 0.1 | =+(((C8+D8)/2)-((C9+D9)/2))/100 |
| 1/2" | 12.5 | 90 | 100 | 0.48 | 0.75 | =+(((C9+D9)/2)-((C12+D12)/2))/100 |
| 3/8" | 9.5 | 0 | 0 | 0 | 0 | =(+E10+F10)/2 |
| #4 | 4.75 | 0 | 0 | 0 | 0 | =(+E11+F11)/2 |
| #8 | 2.36 | 25 | 42 | 0 | 0.26 | =+(((C12+D12)/2)-((C13+D13)/2))/100 |
| #16 | 1.18 | 0 | 26 | 0 | 0.06 | =+(((C13+D13)/2)-((C14+D14)/2))/100 |
| #30 | 0.6 | 0 | 20 | 0 | 0.06 | =+(((C14+D14)/2)-((C15+D15)/2))/100 |
| #50 | 0.3 | 0 | 16 | 0 | 0.16 | =+(((C15+D15)/2)-((C17+D17)/2))/100 |
| #100 | 0.15 | 0 | 0 | 0 | 0 | =(+E16+F16)/2 |
| #200 | 0.075 | 2 | 8 | 0 | 0.08 | =+(((C17+D17)/2)-((C18+D18)/2))/100 |
| | | | | | | =SUM(G6:G17) |
| A | B | C | D | E | F | G |

FIG 5C

| | | | |
|---|---|---|---|
| TYPE-1 | LAYER | CHANGE | NEW |
| (AVG.) | 1.5 | +/- | MIX |
| 0 | =+H6*I$4 | 0 | =+((I6+J6)*100/(I$19+J$19))/100 |
| =07 | =+H7*I$4 | 0 | =+((I7+J7)*100/(I$19+J$19))/100 |
| =08 | =+H8*I$4 | 0 | =+((I8+J8)*100/(I$19+J$19))/100 |
| =09 | =+H9*I$4 | 75 | =+((I9+J9)*100/(I$19+J$19))/100 |
| =010 | =+H10*I$4 | 0 | =+((I10+J10)*100/(I$19+J$19))/100 |
| =011 | =+H11*I$4 | 0 | =+((I11+J11)*100/(I$19+J$19))/100 |
| =012 | =+H12*I$4 | 0 | =+((I12+J12)*100/(I$19+J$19))/100 |
| =013 | =+H13*I$4 | 0 | =+((I13+J13)*100/(I$19+J$19))/100 |
| =014 | =+H14*I$4 | =-I14/(SUM(I$14:I$17))*25 | =+((I14+J14)*100/(I$19+J$19))/100 |
| =015 | =+H15*I$4 | =-I15/(SUM(I$14:I$17))*25 | =+((I15+J15)*100/(I$19+J$19))/100 |
| =016 | =+H16*I$4 | =-I16/(SUM(I$14:I$17))*25 | =+((I16+J16)*100/(I$19+J$19))/100 |
| =017 | =+H17*I$4 | =-I17/(SUM(I$14:I$17))*25 | =+((I17+J17)*100/(I$19+J$19))/100 |
| =SUM(H6:H18) | =SUM(J6:J18) | =SUM(J6:J18) | =SUM(K6:K18) |
| H | I | J | K |

FIG 5D

| | |
|---|---|
| QUALITY CONT'L | CELL NO. |
| =IF(K6>0,"HIGH","OK") | 6 |
| =IF(K7>0.02,"HIGH","OK") | 7 |
| =IF(K8>0.1,"HIGH","OK") | 8 |
| =IF((K9+K10)<0.47,"LOW","OK") | 9 |
| =IF((K10+K9)<0.47,"LOW","OK") | 10 |
| =IF((K11+K10+K9)>0.75,"HIGH","OK") | 11 |
| =IF((K12)>0.25,"HIGH","OK") | 12 |
| =IF((K13+K14+K15+K16+K17)>0.25,"HIGH",IF(K13>0.06,"HIGH","OK")) | 13 |
| =IF((K13+K14+K15+K16+K17)>0.25,"HIGH",IF(K14>0.06,"HIGH","OK")) | 14 |
| =IF((K15+K16+K17)>0.15,"HIGH","OK") | 15 |
| =IF((K16+K17)>0.07,"HIGH","OK") | 16 |
| =IF(K17>0.07,"HIGH","OK") | 17 |
| =IF(SUM(L6:L17)>0,"P","PASSED") | 19 |
| L | M |

FIG 5E

| PAVEMENT AGGREGATE | | |
|---|---|---|
| EXISTING | EXISTING | EXISTING |
| TYPE-1B | TYPE-1A | TYPE-1 |
| | | |
| =+((T7+U7)/2)-((T8+U8)/2) | =+((V7+W7)/2)-((V8+W8)/2) | =+((X7+Y7)/2)-((X8+Y8)/2) |
| =+((T8+U8)/2)-((T9+U9)/2) | =+((V8+W8)/2)-((V9+W9)/2) | =+((X8+Y8)/2)-((X9+Y9)/2) |
| =+((T9+U9)/2)-((T11+U11)/2) | =+((V9+W9)/2)-((V10+W10)/2) | =+((X9+Y9)/2)-((X10+Y10)/2) |
| 0 | =+((V10+W10)/2)-((V11+W11)/2) | =+((X10+Y10)/2)-((X11+Y11)/2) |
| =+((T11+U11)/2)-((T12+U12)/2) | =+((V11+W11)/2)-((V12+W12)/2) | =+((X11+Y11)/2)-((X12+Y12)/2) |
| =+((T12+U12)/2)-((T14+U14)/2) | =+((V12+W12)/2)-((V14+W14)/2) | =+((X12+Y12)/2)-((X14+Y14)/2) |
| 0 | 0 | 0 |
| =+((T14+U14)/2)-((T16+U16)/2) | =+((V14+W14)/2)-((V16+W16)/2) | =+((X14+Y14)/2)-((X16+Y16)/2) |
| 0 | 0 | 0 |
| =+((T16+U16)/2)-((T17+U17)/2) | =+((V16+W16)/2)-((V17+W17)/2) | =+((X16+Y16)/2)-((X17+Y17)/2) |
| =+((T17+U17)/2)-((T18+U18)/2) | =+((V17+W17)/2)-((V18+W18)/2) | =+((X17+Y17)/2)-((X18+Y18)/2) |
| =SUM(N6:N17) | =SUM(O6:017) | =SUM(P6:P17) |
| N | O | P |

FIG 5F

| | | | | | |
|---|---|---|---|---|---|
| EXISTING TYPE-3 | EXISTING TYPE-4 | | 1B | PERCENT 1B | 1A |
| | | 1-1/2" | | | |
| =+((Z7+AA7)/2)-((Z8+AA8)/2) | =+((AB7+AC7)/2)-((AB8+AC8)/2) | 1" | 100 | 100 | 100 |
| =+((Z8+AA8)/2)-((Z9+AA9)/2) | =+((AB8+AC8)/2)-((AB9+AC9)/2) | 3/4" | 90 | 100 | 97 |
| =+((Z9+AA9)/2)-((Z10+AA10)/2) | =+((AB9+AC9)/2)-((AB10+AC10)/2) | 1/2" | 72 | 90 | 82 |
| =+((Z10+AA10)/2)-((Z11+AA11)/2) | =+((AB10+AC10)/2)-((AB11+AC11)/2) | 3/8" | | | 74 |
| =+((Z11+AA11)/2)-((Z12+AA12)/2) | =+((AB11+AC11)/2)-((AB12+AC12)/2) | #4 | 42 | 60 | 54 |
| =+((Z12+AA12)/2)-((Z14+AA14)/2) | =+((AB12+AC12)/2)-((AB14+AC14)/2) | #8 | 30 | 48 | 42 |
| 0 | 0 | #16 | | | |
| =+((Z14+AA14)/2)-((Z16+AA16)/2) | =+((AB14+AC14)/2)-((AB16+AC16)/2) | #30 | 12 | 29 | 22 |
| 0 | 0 | #50 | | | |
| =+((Z16+AA16)/2)-((Z17+AA17)/2) | =+((AB16+AC16)/2)-((AB17+AC17)/2) | #100 | 6 | 16 | 8 |
| =+((Z17+AA17)/2)-((Z18+AA18)/2) | =+((AB17+AC17)/2)-((AB18+AC18)/2) | #200 | 2 | 8 | 3 |
| =SUM(Q6:Q17) | =SUM(R6:R17) | | | | |
| Q | R | S | T | U | V |

FIG 5G

| | | | | | | |
|---|---|---|---|---|---|---|
| 1A | 1L | 1H | 3L | 3H | 4L | 4H |
| 100 | 100 | 100 | 100 | 100 | 100 | 100 |
| 100 | 100 | 100 | 100 | 100 | 100 | 100 |
| 98 | 97 | 100 | 97 | 100 | 97 | 100 |
| 94 | 80 | 100 | 80 | 100 | 90 | 100 |
| 78 | 58 | 75 | 58 | 78 | 70 | 95 |
| 60 | 42 | 60 | 42 | 64 | 58 | 82 |
| 38 | 19 | 40 | 18 | 40 | 20 | 50 |
| 20 | 6 | 20 | 5 | 20 | 6 | 20 |
| 8 | 3 | 8 | 2 | 8 | 2 | 10 |
| W | X | Y | Z | AA | AB | AC |

FIG 5H

METHOD AND APPARATUS FOR ALTERING AN AGGREGATE GRADATION MIXTURE OF AN ASPHALT CONCRETE MIXTURE

CROSS-REFERENCE TO RELATED APPLICATIONS

This Non-Provisional U.S. Patent Application claims priority of U.S. Provisional Application Ser. No. 60/105,678 filed on Oct. 26, 1998.

BACKGROUND OF THE INVENTION

1. Field of the Invention

The present invention relates generally to reclaiming, rejuvenation and the re-gradation of aggregates of asphalt concrete from pavement surfaces composed thereof and, more specifically, to an apparatus and process for converting existing asphalt concrete pavement mixtures into a paving mixture having improved performance, durability, safety and efficiency over currently used paving mixtures, the improved paving mixture having qualities similar to the asphalt concrete pavement superpave mixture developed under the 1987 Strategic Highway Research Program (SHRP).

2. Description of the Prior Art

The present invention relates to the technology of reclaiming, rejuvenating and the re-gradation of aggregates of asphalt concrete mixtures from pavement surfaces. The process and apparatus of the present invention converts existing asphalt concrete pavement mixtures into a new and improved paving mixture having the qualities of the asphalt concrete pavement "super" mixture developed under the USA, 1987 Strategic Highway Research Program (SHRP). The 1987 Strategic Highway Research Program was a 5-year, large scale, applied research program which was established by the U.S. Congress and aimed at improving the performance, durability, safety and efficiency of the Nation's highway systems.

Asphalt concrete is a major component of the highway system in the United States, covering more than 90 percent of the nation's paved roads. Every year, state and local highway agencies spend $10 billion on asphalt pavements, and private sector expenditures total an additional $5 billion. Steadily increasing traffic volumes and loads are taking their toll on these roads, forcing highway agencies to commit extensive resources to rehabilitation projects. As a result, motorists frequently encounter work zones that disrupt traffic, as well as rough pavements that pose safety risks and damage tires and suspensions. SHRP'S solution was to develop a completely new approach to asphalt mix design—the Superpave system. ("Superpave" is a Registered Trademark of the National Academy of Sciences-NAS). The superpave system provides designers with the tools to custom—design asphalt pavements for the specific weather and traffic conditions at a particular job site, instead of simply replicating existing mixes that have served reasonable well in the past.

The superpave system has three components:

(1) An asphalt binder specification;

(2) A design and analysis system based on the volumetric properties of the aggregates; and (3) Mix analysis test and performance prediction models.

Materials engineers use these components to select materials and a mix design best able to resist two key types of pavement distress: permanent deformation and low-temperature cracking. Permanent deformation can result when a pavement is exposed to heavy traffic and hot weather and lacks the strength to withstand rutting. Low-temperature cracking occurs when the pavement shrinks in cold weather.

Since 1992, when the Strategic Highway Program ended, many highway agencies that have built pavements having a design mix in accordance the specifications for a superpave mix report that the new system is producing more durable pavements. On highways across the country, pavements having a superpave design mix are holding up well to heavy traffic and extremes of climate.

In 1995, for example, the Alabama Department of Transportation (DOT) resurfaced 8 km (5 mi) of badly rutted Route 165 with a superpave mix design. Despite heavy traffic and extremely hot weather, the pavement showed virtually no signs of rutting 2 years later, and the Alabama DOT expects the pavement to last considerably longer than it would have if it were constructed with the conventional mix previously used by the state.

In a similar case, Arizona's DOT used a superpave design mix to construct an overlay on a section of Interstate 10 near Phoenix in 1995. In its first summer, the pavement withstood heavy traffic loads and 17 consecutive days of temperatures above 43 degrees C. (110 degrees F.). The pavement's performance to date indicates that it will be very resistant to permanent deformation.

Superpave design mix pavements have also proven durable in cold climates. After 4 years of cold weather and heavy traffic, early superpave mix test sections constructed on Interstate 43 in Waukesha County and on Interstate 94 in Monroe County, Wisconsin, are holding up much better than adjacent sections constructed using Wisconsin's conventional mix. Cold weather is also no problem for an overlay built using a superpave design mix on a rural road in Blue Earth County, Minn., in August 1995. The overlay is suffering much less low-temperature cracking than a nearby, same-age overlay built using Minnesota's conventional mix.

After building several pavements using mixes that meet the superpave specifications, the Texas DOT predicts that the new superpave mixes will have tremendous benefits. Texas estimates that converting only 25 percent of the asphalt that it now uses to mixes that meet the superpave specifications will save the state $2.2 billion over 30 years.

A study of data from the long-term pavement performance (LTPP) program's general pavement studies (GPS) experiments has determined that using asphalt concrete mixes that meet the superpave mix specifications will prevent permanent pavement deformation or rutting, as it is commonly known, in asphalt pavements. The study, "Rutting Trends in Hot-Mix Asphalt Concrete Pavements," was based on data collected at 575 GPS sites. This study looked at full-depth asphalt pavements, asphalt pavements over a granular base, asphalt pavements over a portland cement treated base and asphalt overlays on asphalt and portland cement pavements. The pavement ranged in age from newly constructed to more than 20 years old. The study team focused on the test sections consisting of asphalt pavements over a granular base, which are the most common types of asphalt pavements existing today. They found that pavements with high levels of rutting on average were generally constructed of asphalt mixes containing more fine aggregate or sand than recommended by the superpave aggregate specifications. Pavements with minimal rutting were within the superpave aggregate specifications.

According to the Federal Highway Administration (FHWA), the study makes it clear that it is well worth the time and effort to use aggregate blends that meet the superpave specifications as a way to prevent excessive rutting and permanent pavement deformation. Since virtually all new superpave mixes are products of highly technical hot-mix asphalt plants, the mixes are composed of carefully metered quantities of predetermined superpave specified sizes of aggregates that are heated, dried and coated with an appropriate amount and grade of an asphalt cement binder. Asphalt cement binders are derivatives of the petroleum refining process and are available in various viscosities for use as determined by local climate and traffic loading conditions.

A highway agency's cost for a superpave mix of all virgin, non-renewal natural resource materials can vary from $35 to $75 per tonne depending upon:

(1) Cost of discovery, collection, refining and hauling of necessary asphalt cement;

(2) Cost of mining, crushing, sizing, separating, storing and handling multiple sizes of aggregates;

(3) Cost of asphalt plant operations including, material handling, fuel for heating, drying and mixing aggregates with asphalt cement; and (4) Cost of hauling to remote paving sites for paving and compaction.

Each tonne (2200 lbs) of superpave mixture is made-up entirely of non-renewable natural resources including: 10–15 gallons of petroleum based asphalt cement plus approximately 2,100 lbs. of aggregate. Additionally, the whole process requires the use of more than 650,000 Btu of energy in non-renewable resource fuels.

It is thus desirable to provide a method and apparatus for converting existing roadways made from pavements having inferior grade mixtures into asphalt having a mixture in accordance with the specifications for a superpave mix. It is further desirable to provide a method and system for paving the existing roadways with the converted asphalt mixture to thereby improve the performance and life of the roadway.

SUMMARY OF THE INVENTION

The present invention relates generally to reclaiming, rejuvenation and the re-gradation of aggregates of asphalt concrete from pavement surfaces composed thereof and, more specifically, to an apparatus and process for converting existing asphalt concrete pavement mixtures into a paving mixture having improved performance, durability, safety and efficiency over currently used paving mixtures, the improved paving mixture having qualities similar to the asphalt concrete pavement superpave mixture developed under the 1987 Strategic Highway Research Program (SHRP).

A primary object of the present invention is to provide a method and apparatus for altering an aggregate gradation mixture of an asphalt concrete mixture that will overcome the shortcomings of prior art devices.

Another object of the present invention is to provide a method and apparatus for altering an aggregate gradation mixture of an asphalt concrete mixture which is able to convert existing pavement on a roadway into a superpave mixture having improved qualities from the existing roadway.

A further object of the present invention is to provide a method and apparatus for altering an aggregate gradation mixture of an asphalt concrete mixture which is able to heat and remove layers of previously paved asphalt from a roadway and convert the removed asphalt into a superpave mixture.

A yet further object of the present invention is to provide a method and apparatus for altering an aggregate gradation mixture of an asphalt concrete mixture wherein the altered asphalt has improved performance, durability, safety and efficiency over the paving mixture being altered.

A still further object of the present invention is to provide an apparatus for altering an aggregate gradation mixture of an asphalt concrete mixture including a heating device for heating and thereby softening the asphalt on a roadway.

A further object of the present invention is to provide an apparatus for altering an aggregate gradation mixture of an asphalt concrete mixture having a milling device for chopping the heated asphalt and thereby removing a layer of asphalt from the roadway.

A further object of the present invention is to provide an apparatus for altering an aggregate gradation mixture of an asphalt concrete mixture including a hopper containing new asphalt concrete mixture materials for combination with the layer of asphalt removed from the roadway and altering the gradation of the existing asphalt into a superpave mixture.

Another object of the present invention is to provide an apparatus for altering an aggregate gradation mixture of an asphalt concrete mixture including a height adjustable shield device for filtering out fine aggregates or sand from the asphalt removed from the roadway to thereby alter the gradation of the existing asphalt into a superpave mixture.

Another object of the present invention is to provide an apparatus for altering an aggregate gradation mixture of an asphalt concrete mixture that is simple and easy to use.

A still further object of the present invention is to provide a method and apparatus for altering an aggregate gradation mixture of an asphalt concrete mixture that is economical in cost to manufacture.

Additional objects of the present invention will appear as the description proceeds.

The present invention consists of a process and apparatus for recovering existing rutted and cracked asphalt concrete highway material for reuse in making a new mixture which meets all the specifications for a superpave mixture. Most existing asphalt concrete paving mixtures used in the past were specified and mixed according to various standard specifications. These standard specifications required older asphalt concrete mixtures to adhere to various percentages, as measured by weight, of crushed stone aggregates which could be measured in sizes from the largest of ½" diameter to the smallest of very fine sand. Before formation of the superpave system, standard mixes which were commonly used by most DOT's included:

(1) Type-4 mixtures made up of asphalt cement with very small aggregates;

(2) Type-3 and Type-4 mixtures made up of asphalt cement and slightly larger aggregates; and (3) Type-1A and Type-1B which were made up of asphalt cement and even higher percentage of larger aggregates.

Curiously, all of these former standard mixes contained high percentages, when compared to the new superpave mixes, of fine aggregates and/or sand, which according to the new research data, is the very ingredient most responsible for rutting and/or permanent pavement deflection. Thus, when a certain percentage of the unnecessary fine aggregates are removed and necessary large aggregates are added, the new mix will be in compliance with the volumetric mix specifications for the standard superpave mix.

FIGS. 1A–1H provide a "Pavement Aggregate Gradation Modification Chart" used to calculate the changes that are required to convert any existing mix into the volumetric equivalent to a superpave mix. For example, when a one square yard sample of previously paved using Type-1 asphalt cement mix is analyzed for weight, a thin layer with a thickness of 1½" will have a total weight of approximately 150 pounds (100 lbs/sqyd/1 in. layer). That being so, the combined weight of the various size aggregates of the Type-1 mix totals 150 pounds as shown under column (9) having the heading "LAYER" of FIG. 5A. In the instant example, the modification chart also indicates that 75 pounds of ½ in. large sized aggregates must be added and a total of 25 lbs., or about 60% of all fine aggregates and/or sand 0.6 mm or smaller in size must be removed in order for the resulting mix to be in compliance with the standard superpave volumetric mix specifications. Such is indicated by column (10) having the heading "CHANGE" of FIG. 5A.

The preferred process for altering the volumetric mix of existing asphalt concrete mixes would be to convert to mixes which meet or exceed the typical standard superpave volumetric mix specifications. It is possible to eliminate at least a small percentage of the fine aggregates and/or sand and thus produce an improved mix that is more resistant to rutting and/or permanent pavement deflection than was the original mixture. In many instances it is easy and therefore preferable to convert an existing mix from its present grade or type to a mix that is one or two grades better and therefore an overall improved and renewed mix. However, there may be instances when it is not feasible to convert a relatively fine aggregate mix such as a Type-4 mix to conform 100% to the standard superpave volumetric mix specifications.

In accordance with this process for altering existing asphalt concrete pavement mixes, the road pavement remixing apparatus disclosed herein is able to completely upgrade and renew old roadway surface materials to conform to the most desirable standard superpave mix, without requiring large amounts of new mix materials. Briefly, the road pavement remixing apparatus of this invention provides means for heating the existing pavement surface with propane fueled heaters similar to the apparatus disclosed in my previous U.S. Pat. No. 4,711,600 or other effective heaters which will heat up to a 1" layer of the exposed asphalt concrete very quickly. The apparatus may include a storage hopper and metering device to accept and dispense either asphalt coated or non-coated aggregates, such as the larger aggregates which may be required to be added to convert the existing roadway mix to meet the desired superpave volumetric mix specifications. New aggregates and/or previously processed and windrowed existing roadway materials may also be introduced into the road pavement remixing apparatus by way of the windrow loading drag-bar conveyor which picks up wind-rowed materials from in front of the pavement remixing apparatus and therefore cleans and exposes the existing roadway surface for the heating process. The picked up and conveyed windrowed or hopper fed materials are dumped into a transfer auger conveyor which moves the picked up materials to the outside edges of the passed over heater and discharges them behind the heater onto the surface of the newly heated existing asphalt cement and in front of the outside milling and mixing augers. The outside milling and mixing augers mill the just heated layer of asphalt cement materials from the roadway and mixes milled materials with the conveyed materials creating a homogenous mixture of conveyed and milled materials. The mill cutting teeth are set on the milling drum behind and slightly off-set from each other in a spiral pattern for auguring the new mixture toward the center of the apparatus and in front of a center milling and mixing auger.

A half-round shield plate with a radius slightly larger than the outer radius of the milling auger is positioned behind the milling-mixing auger and acts as a half-round conduit for containing the milled and mixed material for conveyance toward the center of the road pavement remixing apparatus and in front of the rear centered milling, mixing and windrowing auger. This shield plate is, after adjustment as to the height of the bottom edge above the just milled road surface, locked in place with the back support foot of the long-arm draw-bar. The purpose of the locked in position half round shield is to provide an open clearance above the milled roadway surface. The shield plate clearance is adjusted so that the bottom edge is set from between substantially 0" and substantially ½" above the roadway surface depending upon the size and amount of the small aggregate and/or sand being removed from the existing roadway mix. The small aggregates and/or sand, which upon settling to the just milled surface during mixing action, thus pass under the shield plate and through the longitudinal slotted opening formed by the top of the milled surface and the bottom of the shield plate.

Thus, if the volumetric mix specifications require that 25 lbs/yd.$^2$ of fine aggregates and/or sand be removed from the milled existing pavement mix, the height of the shield bottom above the milled surface will be set at ¼" or slightly more as necessary to obtain the quantity of fine aggregates and/or sand materials which equals the weight of the desired removal as is indicated in FIGS. 5A–5H.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 4:
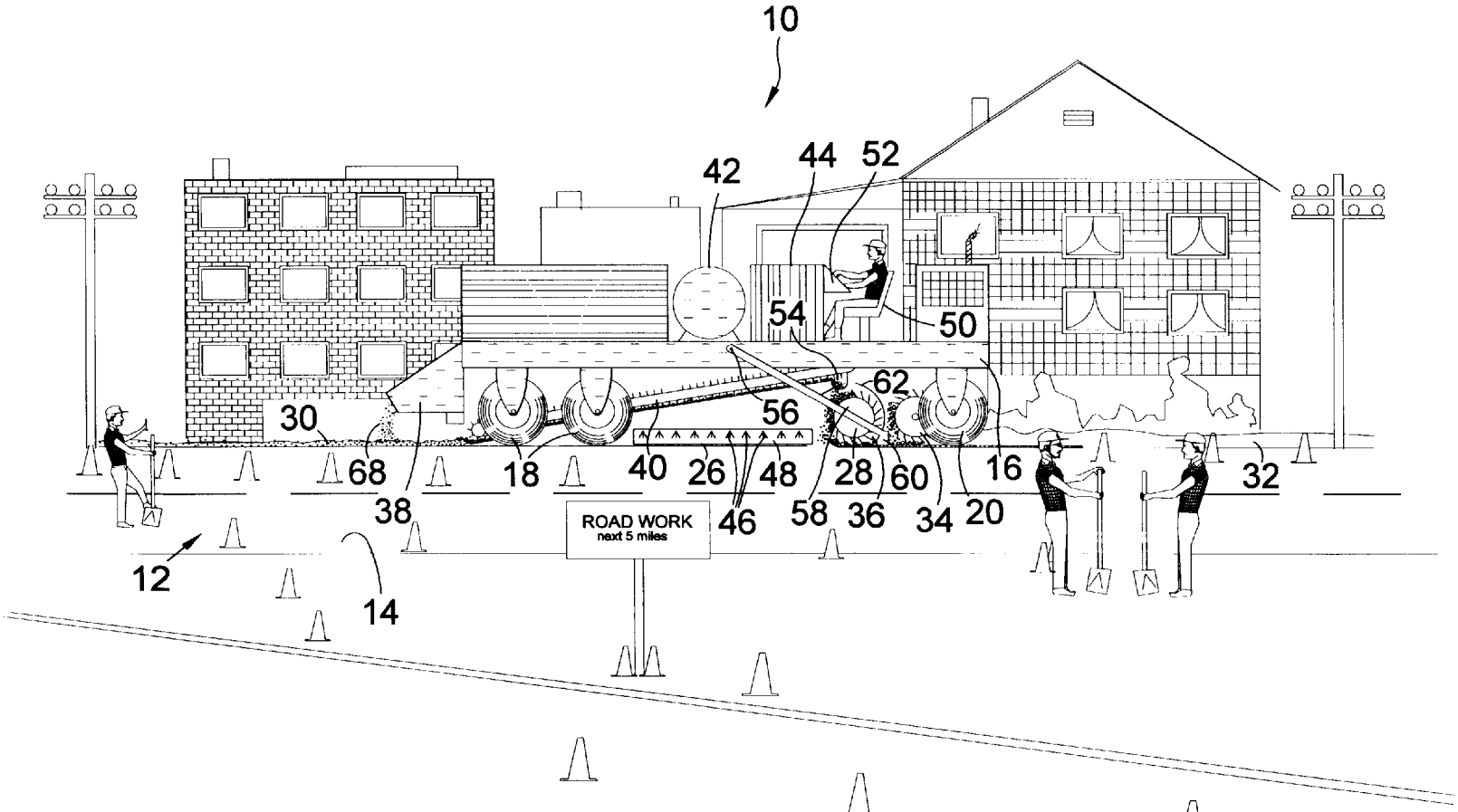

FIG. 4 is a side view of the apparatus for altering an aggregate gradation mixture of an asphalt concrete mixture of the present invention converting the asphalt on a roadway to a superpave mixture; and FIGS. 5A–5H illustrate a "Pavement Aggregate Gradation Modification Chart" used to calculate the changes that are required to convert any existing mix into the volumetric equivalent to a superpave mix.

DESCRIPTION OF THE REFERENCED NUMERALS

Turning now descriptively to the drawings, in which similar reference characters denote similar elements throughout the several views, the Figures illustrate the method and apparatus for altering an aggregate gradation mixture of an asphalt concrete mixture of the present invention. With regard to the reference numerals used, the following numbering is used throughout the various drawing figures.

10 apparatus for altering an aggregate gradation mixture of an asphalt concrete mixture of the present invention
12 roadway
14 a layer of existing pavement
16 structural steel frame
18 front steering wheel supports
20 rear drive wheels supports
22 power train
24 arrow indicating direction of travel of the pavement remixing machine
26 heater
28 milling-mixing auger
30 existing roadway pavement materials
32 windrow pile
34 single rear milling-mixing auger
36 multiple milling bits
38 new materials hopper
40 drag bar conveyor
42 propane storage tank
44 gas train control cabinet
46 ribbon burners
48 heating furnace chamber
50 operator seat
52 control panel
54 auger conveyor
56 front pivot
58 long-arm draw-bar
60 back support foot
62 shield
64 windrow formed by rear milling-mixing auger
66 sand
68 new mix from hopper

DETAILED DESCRIPTION OF THE PREFERRED EMBODIMENT

Turning now descriptively to the drawings, in which similar reference characters denote similar elements throughout the several views, FIGS. 1 through 4 illustrate the apparatus for altering an aggregate gradation mixture of an asphalt concrete mixture of the present invention indicated generally by the numeral 10.

Figure 1:
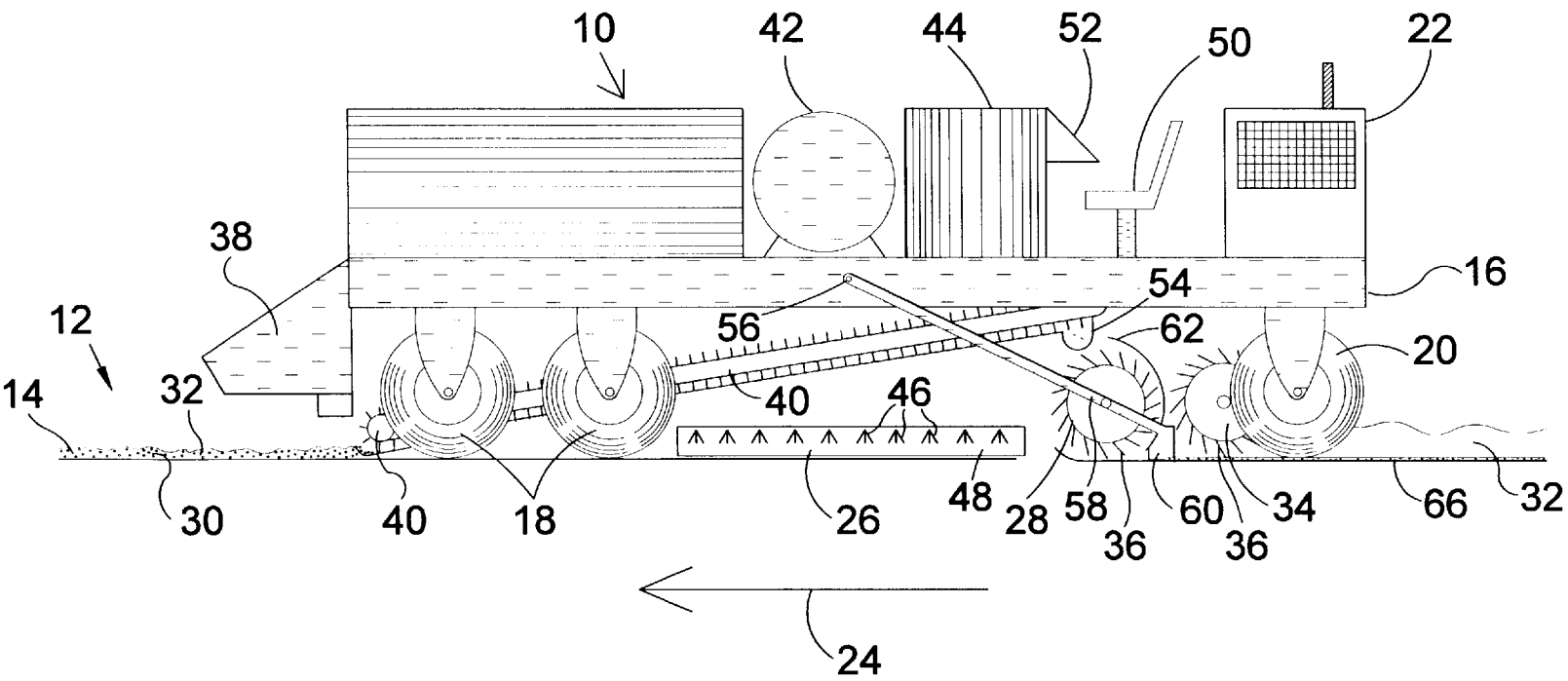
FIG. 1 is a side view of the apparatus for altering an aggregate gradation mixture of an asphalt concrete mixture of the present invention.

FIG. 1 illustrates a side elevation view of a road pavement remixing machine 10 positioned on a roadway 12 including a layer of existing pavement 14 thereon. The pavement remixing machine 10 includes a structural steel frame 16 set on front steering wheel supports 18 and on rear drive wheels supports 20. A power train 22 is set on the steel frame 16 and includes a diesel powered engine and high pressure hydraulic pumps for driving hydraulic motors located on various work station components of the pavement remixing machine 10. The direction of travel of the pavement remixing machine 10 along the roadway 12 is indicated by reference numeral 24.

A heater 26 is connected to the pavement remixing machine 10 below the steel frame 16 and between the front steering wheel supports 18 and the rear drive wheel supports 20 and is positioned at a desired distance above the roadway 12. The height of the heater 26 is adjustable based upon the amount of heat desired and the temperature to which it is desired to heat the roadway 12. The high temperature heating furnace 26 is fired with propane gas from a propane storage tank 42 after it is mixed with sufficient amounts of pressurized combustion air by a gas train of mixing valves, pressure regulators, high pressure fan and pre-heated coil located in a gas train control cabinet 44. The heating furnace 26 is equipped with multiple rows of ribbon burners 46 and flexible front, sides and back skirts to allow pressurization of the heating furnace chamber 48 as it passes over the roadway surface.

During a first pass along the roadway 12, the existing pavement is heated by the heater 26 and milled and mixed by a milling-mixing auger 28. Existing roadway pavement materials 30 are left in a windrow pile 32 on the roadway 12. The milling-mixing auger 28 includes left and right milling-mixing augers for milling and mixing the roadway pavement 14 heated by the heater 26 as the pavement remixing machine 10 travels along the roadway 12. A single rear milling-mixing auger 34 is positioned behind the milling-mixing auger 28 for further milling and mixing of the pavement 14. Each of the left milling mixing auger, right milling-mixing auger and the single rear milling-mixing auger 34 rotate in a counterclockwise direction and include multiple milling bits 36 for milling and mixing the pavement 14 of the roadway 12. The milling bits of the left and right milling-mixing augers are formed in a spiral pattern such that the milled and mixed material will be swept towards a center line of the pavement remixing machine 10 and in front of the rear milling mixing auger 34. The rear milling-mixing auger 34 is thus able to further mill and mix the material deposited thereinfront by the milling-mixing auger 28. Multiple milling bits 36 are also attached to the rear milling-mixing auger 34. These milling bits 36 are attached in a left hand spiral pattern on one end and in a right hand spiral pattern on the other end such that the milled and mixed material form both sides will be swept toward the center line of the pavement remixing machine 10 and left as a homogenous asphalt concrete mix.

Figure 3:
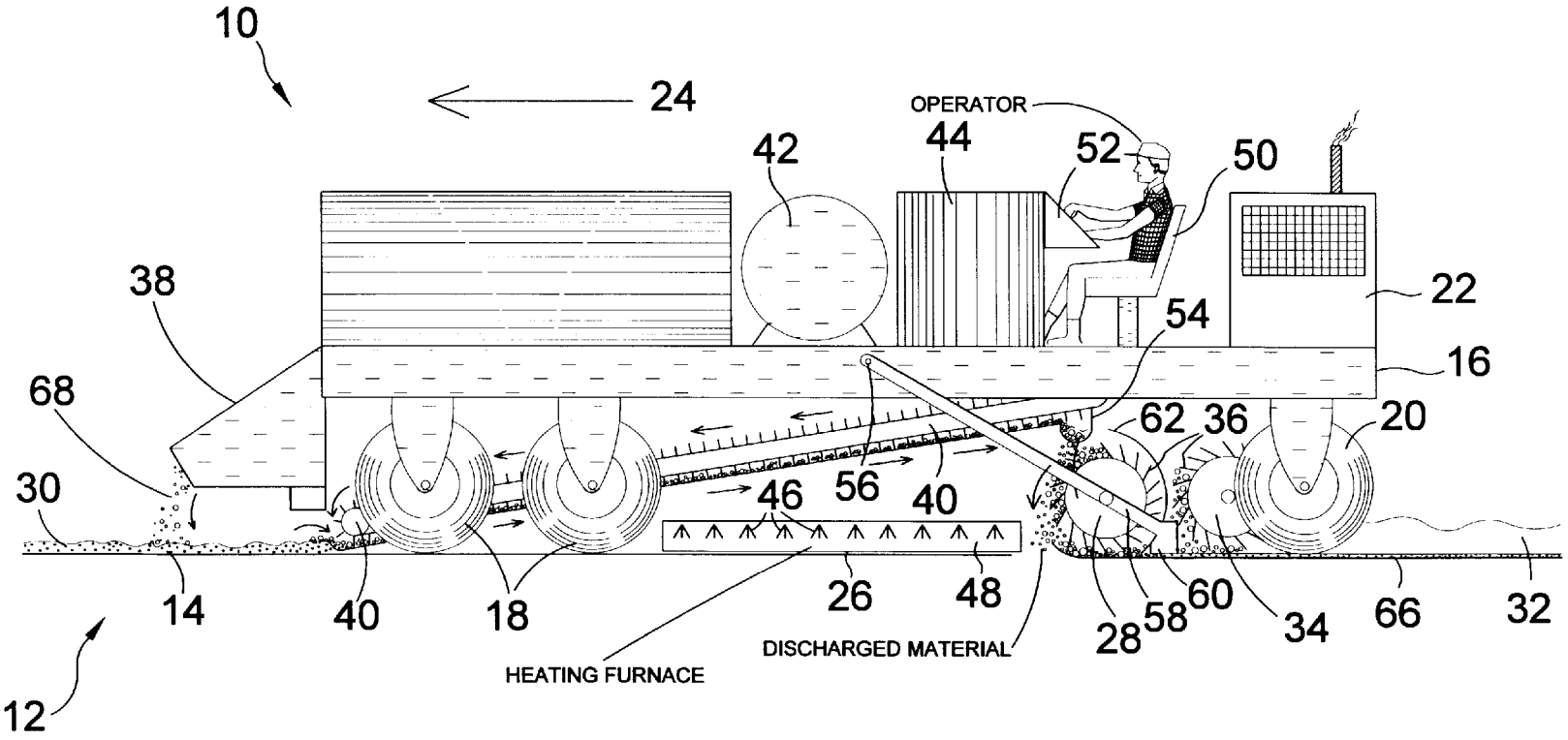
FIG. 3 is a side view of the apparatus for altering an aggregate gradation mixture of an asphalt concrete mixture of the present invention illustrating operation thereof.

A hopper 38 is provided in a front of the steel frame 16 for depositing new asphalt concrete mixtures necessary for altering the mixture of the windrow pile 32 formed on the roadway 12 as can be seen in FIGS. 3 and 4. The materials from the new materials hopper 38 are metered out at a pre-selected rate and dropped onto the windrow pile 32 to be swept up and lifted from the roadway surface by a drag-bar conveyor 40. The heated, milled, mixed pavement which was left in the windrow pile 32 is swept from the road into the drag-bar conveyor 40 along with the new asphalt concrete mixtures deposited by the hopper 38. The dragbar conveyor 40 extends from the front of the pavement remixing machine 10 and over the heater 26 towards the milling-mixing auger 28. The picked up windrow pile 32 is discharged from the drag bar conveyor 40 into an auger conveyor 54 which transfers one-half of the picked up material for discharge between the milling bits 36 of the left front of the left-side milling-mixing auger and one-half of the picked up material for discharge between the milling bits 36 of the right front of the right-side milling-mixing auger. The milling-mixing augers 28 and the single rear milling-mixing auger 34 rotate counter clock-wise when viewed as shown in FIG. 1, thus down-cutting and milling the heated and softened existing asphalt concrete to a predetermined depth.

Figure 2:
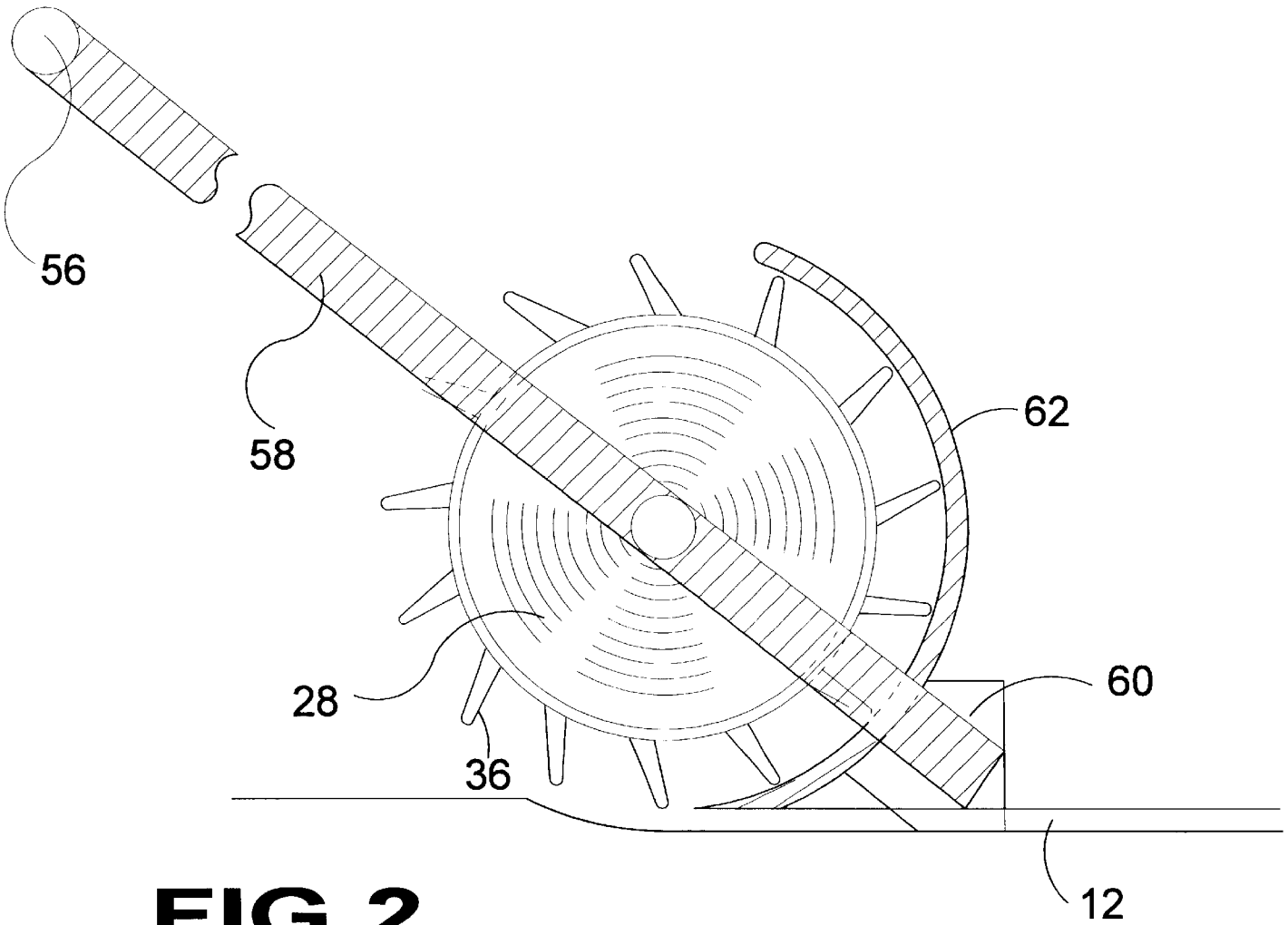
FIG. 2 is a side view of the milling and mixing auger of the apparatus for altering an aggregate gradation mixture of an asphalt concrete mixture of the present invention.

The milling-mixing auger 28 is supported near the back end of a front pivot 56 of a long-arm draw-bar 58 which extends from a front pivot connected to the steel frame 16 through auger axis and to a back support foot 60 as can be seen in FIG. 2. FIG. 2 is an enlarged side view of milling-mixing auger 28 and half rounded shield plate 62. The geometry of such an arrangement causes the bottom most part of the milling-mixing auger 28 and thus the depth of cut and the bottom of the back support foot 60 to move exactly parallel with the line of travel of the front pivot 56 of the long-arm draw-bar 58.

Positioned behind the milling-mixing auger 28 is a shield plate 62. The half rounded shield plate 62 is positioned behind the milling-mixing auger 28 so that it can be rotated around the center rotating axis of milling-mixing auger 28. The half rounded shield plate 62 is spring loaded to rotate in a clock-wise direction so as to scrape and clean the surface of the just milled roadway or stopped from rotation and locked to the back support foot 60 in a position just above the milled roadway surface so that a desired amount of fine aggregates and/or sand, which have settled to the bottom of the mixture due to the mixing action, can pass under the half rounded shield plate 62 and thereby be removed from the resulting mix in order to meet the intended volumetric properties of the aggregates in the new mix. The resulting thin layer of fine aggregates and/or sand can be scraped to the outer edges of the roadway and discarded or left in place as a binder and paving base for the resulting new mix. The layer of fine aggregates and/or sand is relatively thin as compared to the much thicker repaved new mix and therefore not structurally significant in the attempt to prevent permanent pavement deflection of the much thicker repaved new mix in the future.

The half rounded shield plate 62 is adjustable as to the height of the bottom edge above the just milled road surface is locked in place with the back support foot 60 of the long-arm draw-bar 58. The purpose of the locked in position of the half rounded shield plate 62 is to provide an open clearance above the milled roadway surface. The clearance of the shield plate 62 is adjusted so that the bottom edge is set from between substantially 0" and substantially ½" above the roadway surface depending upon the size and amount of the small aggregate and/or sand 66 being removed from the existing roadway mix. However, in practice the height of the shield plate 62 is not limited to ½" and can be any height desired or required to form the superpave mix.

A seat 50 is provided on the steel frame 16 for accommodating an operator of the pavement remixing machine 10 and a control panel 52 is provided in a position in front of the operator seat 50 for controlling the operation of the pavement remixing machine 10. The control panel 52 is positioned so as to be easily reached by the operator when in the seat 50.

The operation of the apparatus for altering an aggregate gradation mixture of an asphalt concrete mixture will now be described with reference to the figures and specifically FIGS. 3 and 4. In operation, the apparatus for altering an aggregate gradation mixture of an asphalt concrete mixture 10 is brought to a roadway on which it is desired to convert the existing pavement into a superpave mixture and thus increase the performance, durability, safety and efficiency of the roadway. The apparatus 10 is driven over the roadway a first time with the heater 26 turned on, the milling-mixing augers 28 and 34 rotating and the hopper 38 providing a desired amount of new material to the roadway which will alter the composition of the existing roadway into a superpave mixture. The amounts and types of new materials needed to convert the pavement of an existing roadway is determined from the charts of FIGS. 5A–5H. These charts provide information on all of the commonly used asphalt concrete mixtures and what is needed to change the composition to form a superpave mixture. The necessary amounts are placed in the hopper 38 for deposit on the roadway 12. The milling-mixing auger 28 is set at a desired height based upon the thickness of a layer of pavement 14 that is desired to be milled. Preferably, the milling-mixing auger 28 will be set to mill a slab of roadway having a thickness of between substantially 0" to substantially substantially a ½" at one time. However, the milling-mixing auger 28 can be set to mill a slab of roadway having any desired thickness. The thickness of the slab to be milled being dependent upon the depth to which the heater is able to heat the pavement of the roadway.

The apparatus 10 is then driven over the roadway 12 a first time. As the apparatus traverses the roadway 12, the hopper 38 deposits the material placed therein on the roadway 12. This material is picked up by the drag bar conveyor 40 and travels therealong over the heater 26 and back to the milling-mixing auger 28, on top of which it is deposited. The heater 26 is heated at this time and acts to heat the pavement 14 to a temperature at which it can be easily broken up.

As the milling-mixing auger 28 passes along the roadway 12, it mills a layer of pavement having a thickness based upon the height at which it is set using the milling bits extending therearound and the depth at which the heater is able to heat the pavement on the roadway. The material deposited thereon by the drag bar conveyor is received in the milling bits and is deposited on the roadway with the milled pavement. The milling bits are shaped so as to direct the milled pavement and the material deposited thereon along a center line of the apparatus. Positioned behind the milling-mixing auger 28 is a rear milling-mixing auger 34 which will further mix the milled pavement and material deposited therewith by the milling-mixing auger 28.

At this time a second apparatus 10 will pass along the roadway behind and along the path of the first apparatus 10. This second apparatus 10 will not deposit any new material on the roadway 12 as all the new material needed to alter the composition of the pavement to a superpave mix has been deposited by the first apparatus 10. The heater 26 will heat the pavement as it passes thereover. This apparatus will have its milling-mixing auger 28 at a distance below that of the first milling-mixing auger 28 to thereby mill a slice of pavement below the pavement milled by the first apparatus 10. The thickness of the slab of roadway to be milled being based upon the height at which it is set using the milling bits extending therearound and the depth at which the heater is able to heat the pavement on the roadway. As the second apparatus passes along the roadway 12, the drag bar conveyor 40 will pick up the milled pavement and material deposited there by the first apparatus for delivery to the milling-mixing auger thereof The milling-mixing auger 28 will then mill the heated pavement while also receiving the milled pavement and new material picked up by the drag bar conveyor 40. The new material and milled pavement deposited on the milling-mixing auger 28 by the drag bar conveyor 40 is received in the milling bits 36 and is deposited on the roadway with the newly milled pavement. The milling bits 36 are shaped so as to direct the milled pavement and the material deposited thereon along a center line of the apparatus. The newly milled pavement is then mixed with the new material and pavement milled by the first apparatus by the milling-mixing auger 28. Positioned behind the milling-mixing auger 28 is a rear milling-mixing auger 34 which will further mix the milled pavement and material deposited therewith by the milling-mixing auger 28 and provide the mixed combination along a center line of the apparatus.

A shield plate 62 is connected to the milling-mixing auger 28 and is maintained at a height above the surface of the pavement 14. The shield plate 62 is able to allow fine aggregate or sand to pass thereunder and thus be separated from the mixture of milled pavement and new material thus increasing the particle size of the asphalt within the mixture. The fine aggregate or sand passing under the shield plate 62 is left on a side of the roadway and separated from the mixture. This fine aggregate or sand forms a layer positioned beneath the superpave mix and thus the superpave mix remains unaffected thereby. The size of the particles allowed to pass under the shield plate 62 is determined by the height at which the shield plate 62 is set. The shield plate 62 is height adjustable and is set at a height in accordance with the necessary height for forming a superpave mixture as indicated on the charts of FIGS. 5A–5H. Numerous factors determine the height needed for the shield plate 62 including the type of mixture forming the pavement to be converted and the amounts and types of new material added to the milled pavement by the hopper 38.

The process performed by the second apparatus is then repeated with a third apparatus and possibly additional apparatuses until a layer of pavement of a desired thickness is stripped from the roadway and mixed with new material or filtered to remove the fine aggregate or sand therein to form a superpave mix. Preferably, a slab of pavement having a thickness of substantially 1½" is milled by this process. However, a slab having any desired thickness may be milled by simply setting the milling-mixing augers 28 to a desired height and passing any desired number of apparatusses along the roadway in a series fashion. Throughout the process the pavement and mixture is constantly heated and remains at an elevated temperature. At this temperature the pavement is easily removed, milled and mixed by the apparatus and is at a temperature at which it can be easily repaved over the roadway. At this point either a paver is passed along the roadway to pave the roadway with the converted superpave mix or the superpave mix is lifted from the pavement by another apparatus for use at a desired location.

Thus, this apparatus and method of use is able to recycle existing poorly mixed pavements and convert the mixture to a superpave mixture having improved qualities which are able to stand up to changing elements such as cold and heat and also withstand a greater amount of use by vehicles. It is now unnecessary to simply discard old pavement once it is removed as this pavement can be recycled and converted to a pavement having improved qualities which provide improved performance.

From the above description it can be seen that the apparatus for altering an aggregate gradation mixture of an asphalt concrete mixture of the present invention is able to overcome the shortcomings of prior art devices by providing a ladder including storage areas which is able to convert existing pavement on a roadway into a superpave mixture having improved qualities from the existing roadway whereby layers of previously paved asphalt from a roadway are to heated and removed prior to conversion into a superpave mixture. The method and apparatus for altering an aggregate gradation mixture of an asphalt concrete mixture creates a superpave mix having improved performance, durability, safety and efficiency over the paving mixture being altered. The apparatus for altering an aggregate gradation mixture of an asphalt concrete mixture includes a heating device for heating and thereby softening the asphalt on a roadway, a milling device for chopping the heated asphalt and thereby removing a layer of asphalt from the roadway, a hopper containing new asphalt concrete mixture materials for combination with the layer of asphalt removed from the roadway and altering the gradation of the existing asphalt into a superpave mixture and a height adjustable shield device for filtering out fine aggregates or sand from the asphalt removed from the roadway to thereby alter the gradation of the existing asphalt into a superpave mixture. Furthermore, the ladder including storage areas of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method of converting existing roadway materials into a superpave mix comprising the steps of:

a) heating a layer of the existing roadway;

b) removing a first layer of the material forming the heated layer of the existing roadway; and c) mixing the removed first layer of material with a predetermined amount of treated new usable aggregates in order to produce on site a new asphalt concrete mixture while at the same time separating and removing selected unusable aggregates from the material.

2. The method as recited in claim 1, wherein the separated and removed aggregates are of a predetermined size.

3. The method as recited in claim 2, wherein the first layer of material removed has a thickness of substantially ½".

4. The method as recited in claim 3, further comprising the steps of removing a second layer of material and mixing the removed second layer of material with the new asphalt concrete mixture.

5. The apparatus as recited in claim 4, further comprising the steps of removing a third layer of material and mixing the removed third layer of material with the new asphalt concrete mixture and removed second layer of material.

6. The apparatus as recited in claim 4, wherein the second layer of material has a thickness of substantially ½".

7. The apparatus as recited in claim 5, wherein the third layer of material has a thickness of substantially ½".

8. An apparatus for converting existing roadway materials into a superpave mix on site, said apparatus comprising:

a) a heater for heating a layer of existing roadway materials;

b) means for milling and mixing the heated layer of existing roadway materials;

c) means for providing a predetermined amount of treated new usable aggregates to the milling and mixing means for mixing with the heated layer of existing roadway materials in order to produce a new asphalt concrete mixture; and d) shielding means adjacent said milling means adjustably positioned to separate and remove selected unusable aggregates from the material.

9. The apparatus as recited in claim 8, wherein said heater heats the layer of existing roadway to a desired temperature.

10. The apparatus as recited in claim 8, wherein said milling and mixing means is an auger including a plurality of milling bits extending therearound for receiving the predetermined amount of treated new usable aggregates from the providing means and mixing the predetermined amount of treated new usable aggregates with the milled layer of existing roadway materials.

11. The apparatus as recited in claim 10, further comprising a second auger positioned along the center line of the apparatus and behind the milling and mixing means for further mixing the new asphalt concrete mixture.

12. The apparatus as recited in claim 8, wherein the means for providing includes a hopper which is preloaded with the predetermined amount of treated new usable aggregates.

13. The apparatus as recited in claim 12, wherein said means for providing further includes a conveyor able to retrieve the predetermined amount of treated new usable aggregates from said hopper and provide the predetermined amount of treated new usable aggregates to said milling and mixing means.

14. The apparatus as recited in claim 8, wherein said milling and mixing means mills a layer of material having a thickness of substantially ½".

15. A method of converting existing roadway materials into a superpave mix comprising the steps of:

a) heating a layer of the existing roadway;

b) removing a first layer of the material forming the heated layer of the existing roadway and mixing the removed first layer of material with a predetermined amount of treated new usable aggregates;

c) separating and removing selected unusable aggregates from the material in order to produce a new asphalt concrete mixture; and d) depositing on the roadway the newly milled pavement, with said selected unusable aggregates being left on a side of said roadway separated from the new mixture.

16. The method as recited in claim 15, wherein the separated and removed aggregates are of a predetermined size.

17. The method as recited in claim 16, wherein the first layer of material removed has a thickness of substantially ½".

18. The method as recited in claim 17, further comprising the steps of removing a second layer of material and mixing the removed second layer of material with the new asphalt concrete mixture.

19. The apparatus as recited in claim 18, further comprising the steps of removing a third layer of material and mixing the removed third layer of material with the new asphalt concrete mixture and removed second layer of material.

20. The apparatus as recited in claim 19, wherein the second layer of material removed has a thickness of substantially ½".

21. The apparatus as recited in claim 15, wherein the superpave mix has volumetric requirements in accordance with the design system developed by the Strategic Highway Research Program of 1987.

* * * * *